US011064803B2

(12) United States Patent
Watts et al.

(10) Patent No.: US 11,064,803 B2
(45) Date of Patent: Jul. 20, 2021

(54) KIT OF PARTS FOR A KITCHEN UNIT

(71) Applicant: The West Retail Group Limited, Barton-Upon-Humber (GB)

(72) Inventors: Darren Watts, Barton-Upon-Humber (GB); Mark Sellars, Barton-Upon-Humber (GB)

(73) Assignee: THE WEST RETAIL GROUP LIMITED, Barton-Upon-Humber (GB)

( * ) Notice: Subject to any disclaimer, the term of this patent is extended or adjusted under 35 U.S.C. 154(b) by 0 days.

(21) Appl. No.: 16/872,612

(22) Filed: May 12, 2020

(65) Prior Publication Data

US 2020/0359786 A1 Nov. 19, 2020

(30) Foreign Application Priority Data

May 13, 2019 (GB) ..... 1906715

(51) Int. Cl.
*A47B 47/02* (2006.01)
*A47B 47/00* (2006.01)
(Continued)

(52) U.S. Cl.
CPC ..... *A47B 47/027* (2013.01); *A47B 13/003* (2013.01); *A47B 33/00* (2013.01);
(Continued)

(58) Field of Classification Search
CPC ..... A47B 47/027; A47B 13/003; A47B 33/00; A47B 77/00; A47B 2013/006;
(Continued)

(56) References Cited

U.S. PATENT DOCUMENTS 2,930,638 A * 3/1960 Morrissey ..... A47F 5/13 403/217
3,404,931 A * 10/1968 Fall ..... A47B 47/03 312/265.4
(Continued)

FOREIGN PATENT DOCUMENTS

FR 2299834 A1 9/1976
JP 3073028 U 11/2000

*Primary Examiner* — Jennifer E. Novosad
(74) *Attorney, Agent, or Firm* — Michael Best & Friedrich LLP

(57) ABSTRACT

A kit of parts for forming a kitchen unit (100) includes a first frame component (110) having a plurality of tubular edge elements (111-114), a second frame component (120) having a plurality of tubular edge elements (121-123) and a plurality of tubular legs (130,140). The plurality of tubular legs include a plurality of end legs (130), to be secured to the first frame component 110 in a recess (116) disposed between adjacent edge elements (111-114) of the first frame component (110) and a plurality of intermediate legs (140) configured to be secured to the first frame component (110) and the second frame component (120) in a recess defined by an edge element (111-114) of the first frame component (110) and an edge element (121-123) of the second component (120). The kit of parts permits a wide range of kitchen units, such as free-standing towers and islands, to be assembled from a relatively small set of basic components.

19 Claims, 12 Drawing Sheets

(51) Int. Cl.
*A47B 87/00* (2006.01)
*A47B 77/00* (2006.01)
*A47B 33/00* (2006.01)
*A47B 13/00* (2006.01)

(52) U.S. Cl.
CPC ..... *A47B 47/0058* (2013.01); *A47B 87/008* (2013.01); *A47B 77/00* (2013.01); *A47B 2013/006* (2013.01)

(58) Field of Classification Search
CPC . A47B 47/0058; A47B 47/005; A47B 87/005; A47B 87/008; A47B 47/00; A47B 47/0083; A47B 47/0091; A47B 47/02; A47B 47/021; A47B 47/028; A47B 47/0025; A47B 47/0041; A47B 47/0033; A47B 47/045; A47B 87/00; A47B 87/002; A47B 87/007
USPC ..... 211/182, 188, 194, 191, 189, 187; 312/265.1–265.6
See application file for complete search history.

(56) References Cited

U.S. PATENT DOCUMENTS 3,462,021 A * 8/1969 Hawke ..... F16B 7/0493 211/182
3,661,434 A * 5/1972 Alster ..... A47B 87/0207 312/111
3,912,087 A * 10/1975 Zeischegg ..... A47B 87/007 211/194
3,945,696 A * 3/1976 Yellin ..... A47B 47/05 312/265.2
5,383,723 A * 1/1995 Meyer ..... A47B 55/00 312/265.4
5,470,139 A * 11/1995 Hsiao ..... A47B 47/005 312/111
5,609,402 A * 3/1997 Kemp ..... A47B 13/06 211/94.01
5,713,651 A * 2/1998 Essig ..... F16B 12/50 312/265.4
6,044,990 A * 4/2000 Palmeri ..... A47B 47/0016 211/182
6,149,255 A * 11/2000 Benner ..... H02B 1/301 312/257.1
6,152,553 A * 11/2000 Wunderlich ..... A47B 47/0091 108/110
6,164,460 A * 12/2000 Reuter ..... H02B 1/01 211/189
6,223,917 B1 * 5/2001 Bruder ..... A47B 47/0008 211/189
6,299,268 B1 * 10/2001 Carle ..... H02B 1/01 312/265.1
6,968,962 B2 * 11/2005 Toma ..... F16B 12/50 211/182
7,438,195 B2 * 10/2008 Beck ..... B65D 19/12 206/335
7,997,213 B1 * 8/2011 Gauthier ..... B65D 88/022 108/55.1
8,091,970 B2 * 1/2012 Francisquini ..... H02B 1/301 312/265.1
8,231,185 B1 * 7/2012 Trusty ..... B65D 15/22 312/6
8,403,431 B2 * 3/2013 Elkins ..... H05K 7/186 312/265.1
8,708,169 B1 * 4/2014 Chen ..... A47B 47/0083 211/189
8,720,707 B2 * 5/2014 Hong ..... H01L 31/054 211/182
9,204,737 B2 * 12/2015 Lamarre ..... A47B 47/0083
2002/0017839 A1 * 2/2002 Wei ..... A63F 9/00 312/265.1
2002/0171338 A1 * 11/2002 Wetterberg ..... A47B 87/0207 312/265.1
2003/0020382 A1 * 1/2003 Herbeck ..... F24F 13/20 312/265.4
2004/0036389 A1 * 2/2004 Tsai ..... H05K 7/18 312/265.4
2004/0088941 A1 * 5/2004 Boots ..... A47B 47/027 52/655.1
2005/0103734 A1 * 5/2005 Saltzberg ..... A47B 96/1441 211/187
2005/0122013 A1 * 6/2005 Canin ..... A47B 3/06 312/265.1
2007/0062898 A1 * 3/2007 Choi ..... A47B 57/408 211/192
2007/0227994 A1 * 10/2007 Cho ..... A47B 47/005 211/188
2007/0257585 A1 * 11/2007 Kenny ..... F16B 12/50 312/265.4
2012/0146471 A1 * 6/2012 Centazzo ..... A47B 47/00 312/265.1
2013/0249363 A1 * 9/2013 Liu ..... A47B 47/0008 312/265.1
2013/0319296 A1 * 12/2013 Lio ..... F16B 12/40 108/157.1
2014/0124468 A1 * 5/2014 Lundrigan ..... A47B 47/021 211/182
2017/0156486 A1 * 6/2017 Blick ..... F16B 12/30
2017/0164734 A1 * 6/2017 Steele ..... F16B 12/50
2017/0290421 A1 * 10/2017 Wood ..... A47B 47/0091
2018/0066691 A1 * 3/2018 Matsumoto ..... A47B 96/1441
2018/0170235 A1 * 6/2018 Millis ..... B60P 3/34
2020/0359786 A1 * 11/2020 Watts ..... A47B 33/00

* cited by examiner

KIT OF PARTS FOR A KITCHEN UNIT

BACKGROUND OF THE INVENTION

The invention relates to a kit of parts for forming a kitchen unit, and a kitchen unit formed from the same. The invention also relates to a method of forming a kitchen unit.

The process of procuring a kitchen typically involves a consultation with a kitchen designer at a showroom. The designer obtains measurements of the customer's kitchen, and information regarding their preferred units and the layout and configuration thereof, and uses this information to produce a kitchen design. The design process may for example be carried out using kitchen planning software. When the design process is complete and the design is approved by the customer, the order is placed and the completed plan is used to manufacture the kitchen. In one example, the kitchen is manufactured to order once the design is placed, with units made from traditional materials such as laminate and timber machined and finished as specified in the plan. In this manner, the practice of stocking large numbers of units in a warehouse can be avoided.

Recently, there has been a desire to provide kitchen units, such as islands and tower units formed from tubular metals such as steel, in order to provide an industrial look. However, manufacturing such units to order, for example by welding tubular elements together, is not practical on a large scale.

SUMMARY OF THE INVENTION

It is an aim of the invention to overcome the above-mentioned difficulties, and any other difficulties that would be apparent to the skilled reader from the description herein.

According to a first aspect of the invention there is provided a kit of parts for forming a kitchen unit, comprising:

a first frame component comprising a plurality of tubular edge elements;

a second frame component comprising a plurality of tubular edge elements; and a plurality of tubular legs, wherein the plurality of tubular legs comprises:

- a plurality of end legs, configured to be secured to the first frame component in a recess disposed between adjacent edge elements of the first frame component; and
- a plurality of intermediate legs configured to be secured to the first frame component and the second frame component in a recess defined by an edge element of the first frame component and an edge element of the second component.

References herein to "tubular" will be understood to be references to substantially hollow components with a substantially constant cross-section. It will be understood that tubular encompasses cross-sections other than circular cross-sections.

Each edge element may be connected to a neighbouring edge element by a bracket.

Each edge element may have a rectangular cross-section.

Each edge element may comprise or be formed from metal, suitably steel.

At least one of the end legs may be securable to its respective first frame component by a bolt extending from its respective first frame component into a respective recess and into the end leg.

At least one of the intermediate legs may be:

securable to its respective first frame component by a first bolt extending from its respective first frame component into a respective recess and into the intermediate leg, and securable to its respective second frame component by a second bolt extending from its respective second frame component into a respective recess and into the intermediate leg.

The or each end leg and/or intermediate leg may comprise an adjustable foot portion at one end thereof.

The kitchen unit may be a tower unit. The kitchen unit may be a kitchen island. The kitchen unit may be freestanding.

The first frame component may comprise a brace. The second frame component may comprise a brace.

The first frame component may comprise four tubular edge elements, each tubular edge element being arranged substantially perpendicularly to a neighbouring edge element.

The second frame component may comprise: three tubular edge elements, each tubular edge element being arranged substantially perpendicularly to a neighbouring edge element, and an open end. The open end may be attachable to at least one of the intermediate legs.

The first frame component may comprise three tubular edge elements, each edge element being arranged substantially perpendicularly to a neighbouring edge element, and a non-tubular edge element connecting two of the tubular edge elements.

The second frame component may comprise a pair of tubular edge elements, and a pair of non-tubular edge elements. A first tubular edge element may be disposed opposite a second tubular edge element. A first non-tubular edge element may be disposed opposite a second non-tubular edge element.

According to a second aspect of the invention there is provided a kitchen unit assembled from the kit of parts of the first aspect.

According to a third aspect of the invention there is provided a method of manufacturing a kitchen unit, comprising assembling the kit of parts of the first aspect.

BRIEF DESCRIPTION OF DRAWINGS

For a better understanding of the invention, and to show how embodiments of the same may be carried into effect, reference will now be made, by way of example only, to the accompanying diagrammatic drawings in which.

DETAILED DESCRIPTION

In summary, this disclosure provides a kit of parts for forming a kitchen unit, comprising a first frame component, a second frame component and a plurality of legs. The legs comprise end legs that are securable to the first frame component, and intermediate legs, which are securable to both the first frame component and second frame component, so as to act as a support for both frame components. Subsequent second frame components can then be attached to the initial second frame component, with further intermediate legs, to provide a layer of frame components of arbitrary length. This kit of parts allows the formation of kitchen units, such as free-standing tower units or islands, in a wide variety of configurations based on a small number of parts.

Figure 1A:
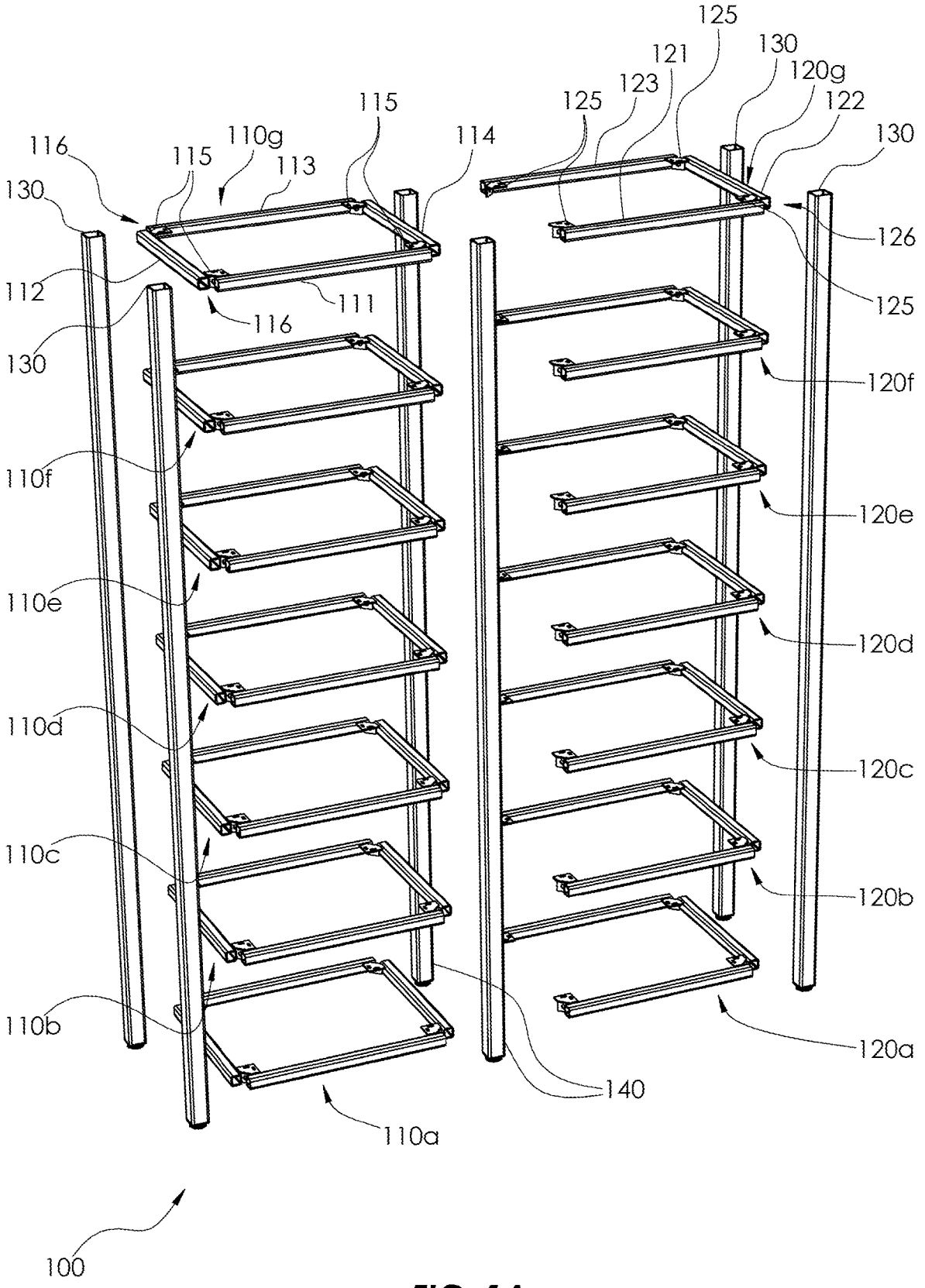
FIGS. 1A and 1B are exploded side and top perspective views of a kitchen unit in accordance with a first example of the disclosure.
Figure 1B:
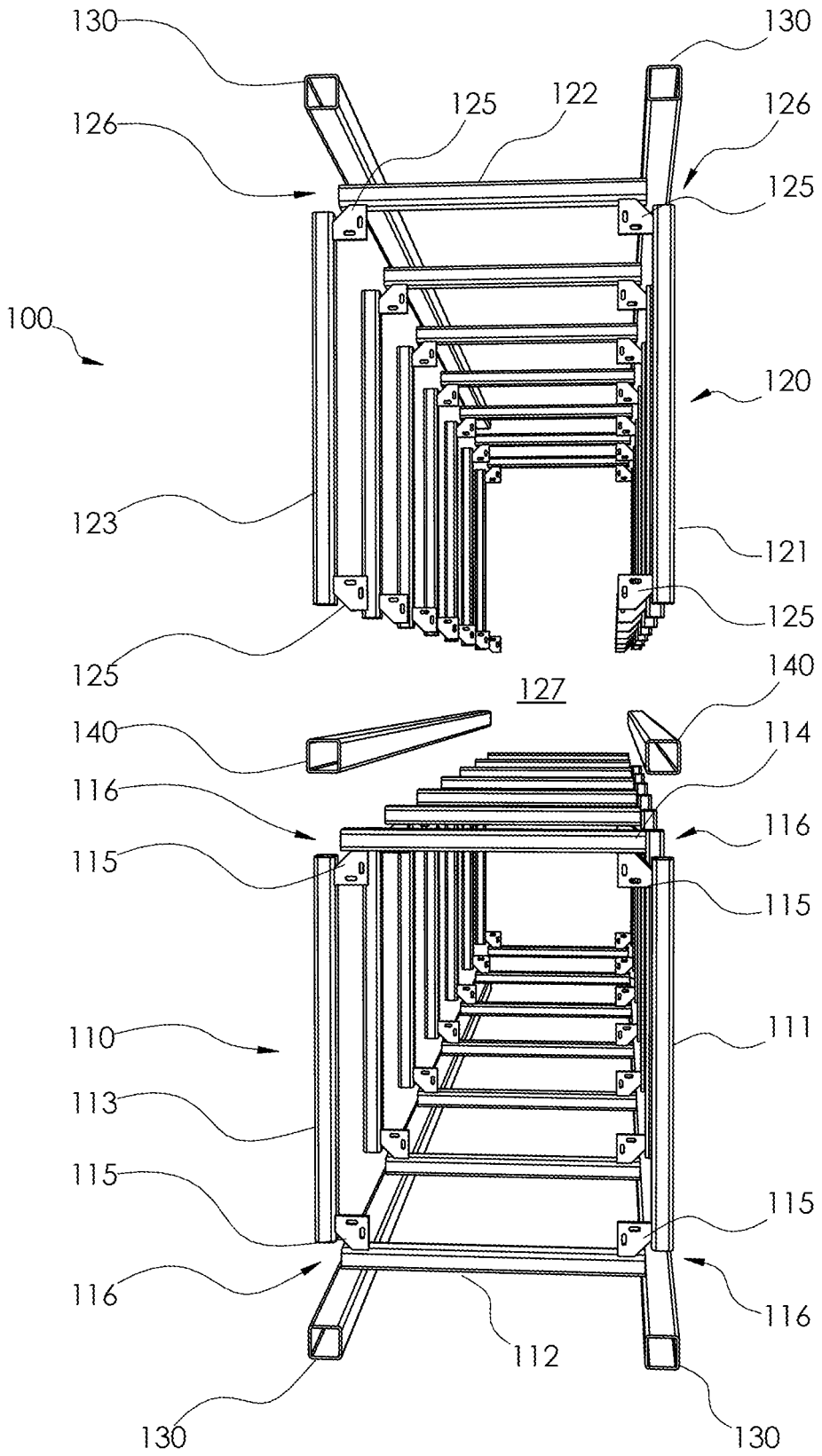
Figure 2A:
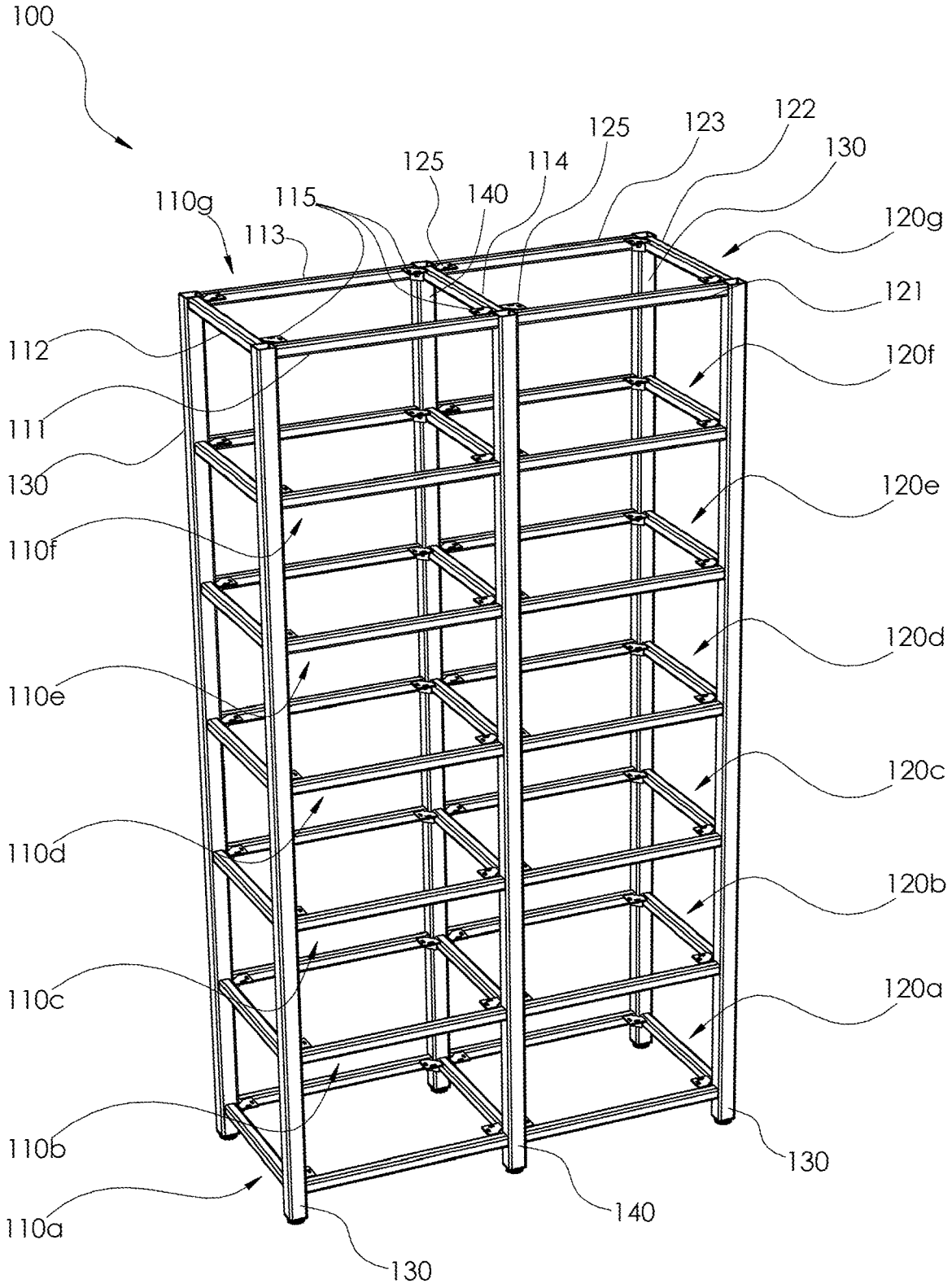
FIGS. 2A and 2B are side and top perspective views of the example kitchen unit of FIG. 1.
Figure 2B:
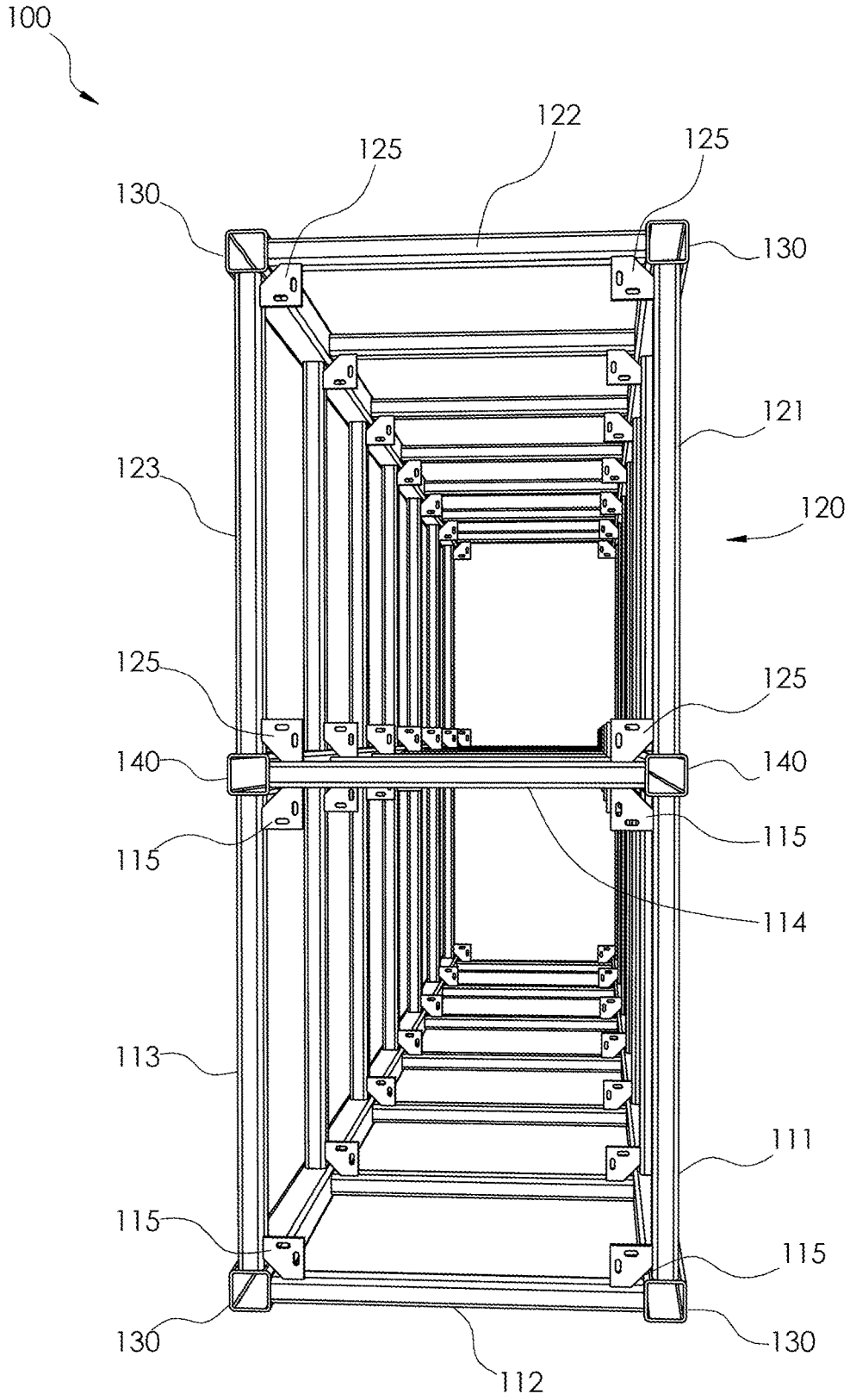
Figure 3:
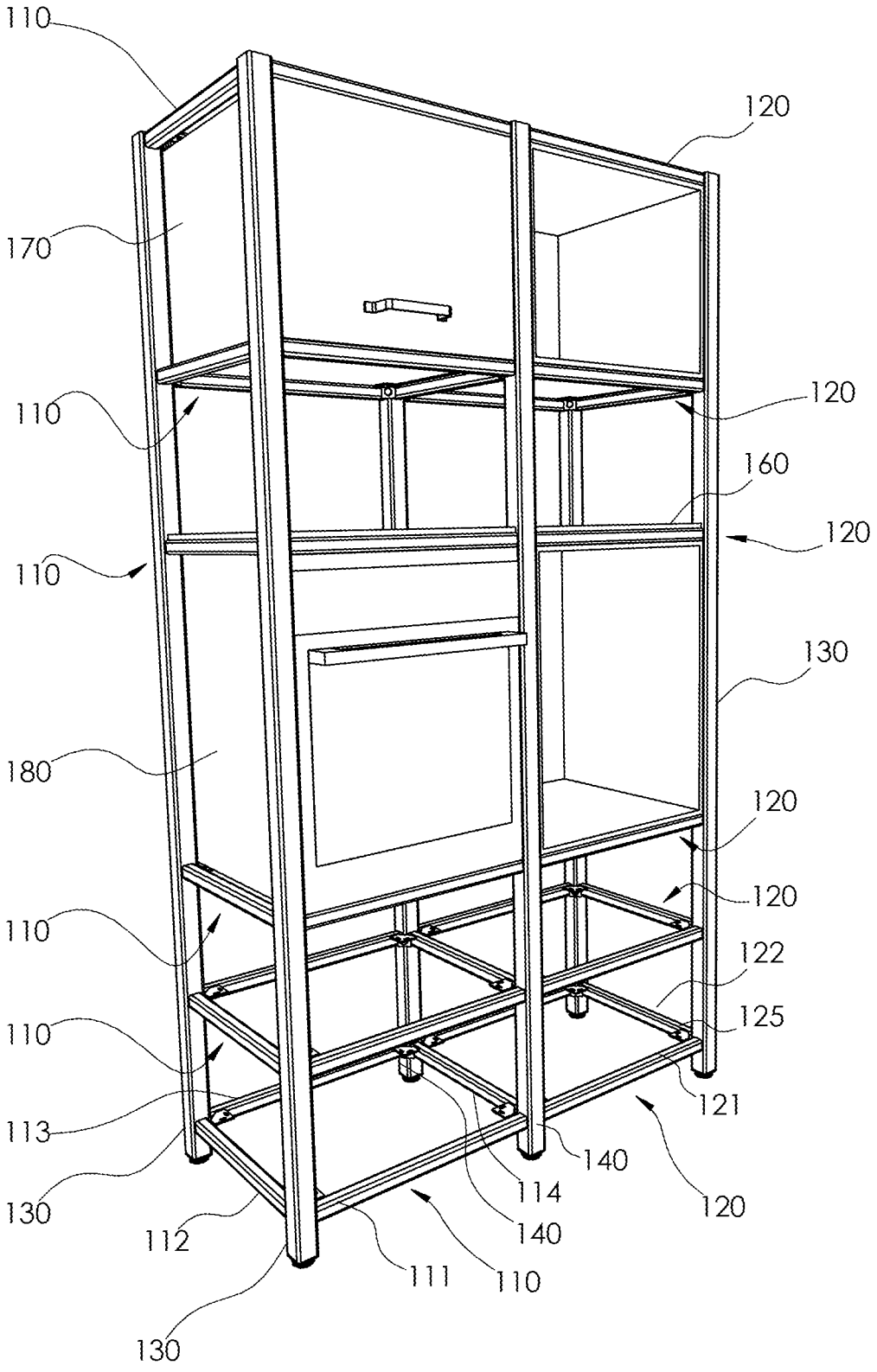
FIG. 3 is a perspective view of an example kitchen unit in accordance with a second example of the disclosure.
Figure 4:
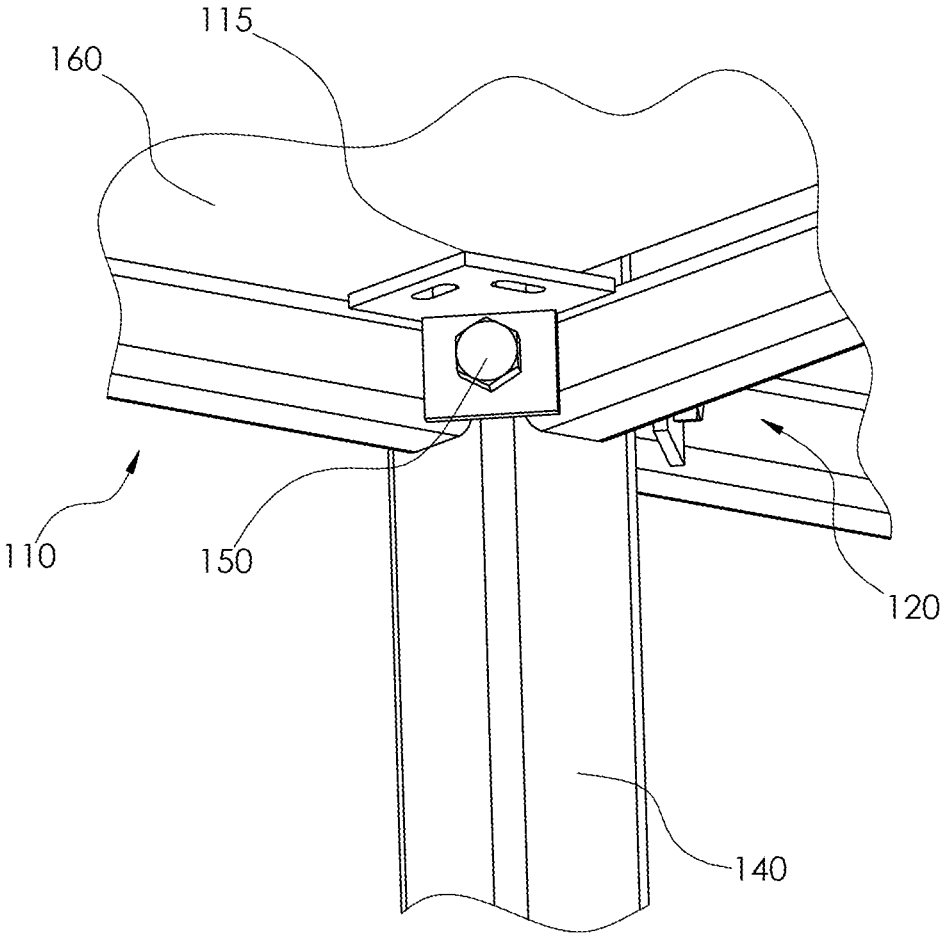
FIG. 4 is a magnified view of a portion of the example kitchen unit of FIG. 3.
Figure 5:
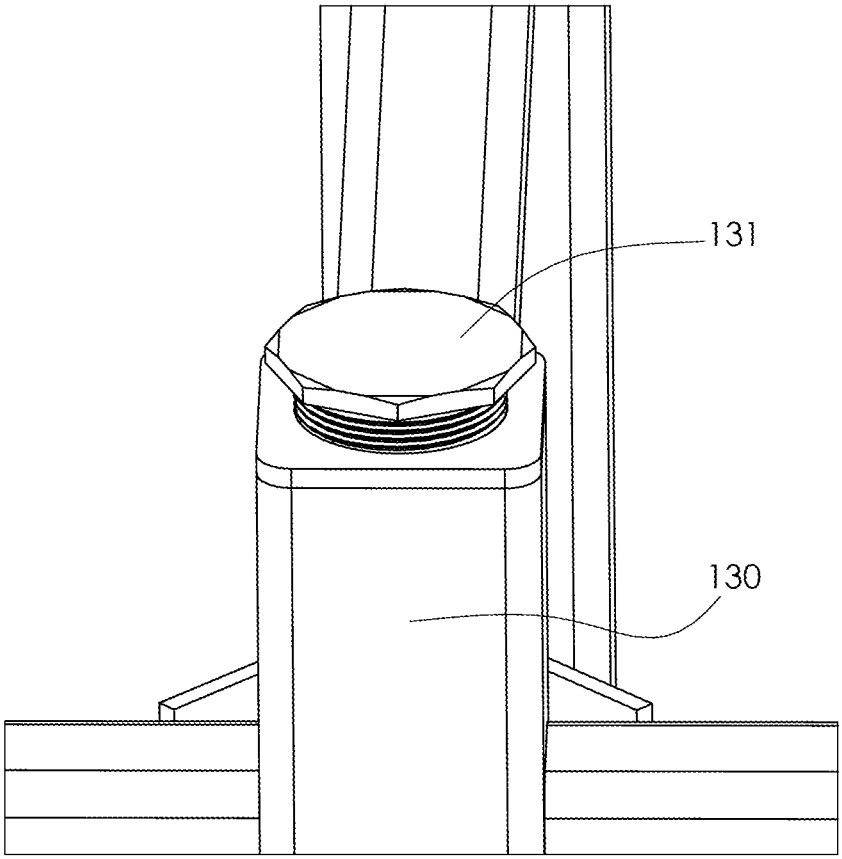
FIG. 5 is a perspective view of a leg of the example kitchen unit of FIGS. 3 and 4.

FIGS. 1-2 show a kitchen unit 100 in accordance with an example of the disclosure. In this example, the kitchen unit 100 is a tower unit. FIGS. 3-5 show another configuration of a tower unit 100 formed from the same component parts, and thus corresponding reference numerals are used. The kitchen unit 100 is formed from a plurality of frame components 110, 120 and a plurality of legs 130, 140. The frame components comprise a plurality of first frame components 110 and a plurality of second frame components 120.

The first frame component 110 is formed from four edge elements 111-114. The each edge element 111-114 is arranged substantially perpendicularly to the neighbouring edge element, so as to form a planar, rectangular frame. In one example, the edge elements are connected by brackets 115 disposed between adjacent edge elements 111-114 within the interior of the frame. The brackets 115 may also be suitable for supporting a shelf 160 (see FIGS. 4 and 5).

In one example, each edge element 111-114 is formed from hollow components having a rectangular (e.g. square) cross-section. These components may be referred to in the art as box section components. Accordingly, the components are tubular. The edge elements 111-114 may be formed from metal, for example steel.

The edge elements 111-114 are sized so as to define a recess 116 between adjacent edge elements 111-114. The recess 116 is sized to receive a leg 130, 140.

The second frame component 120 is similar to the first frame component 110, differing in that one of the edge elements is omitted, so that the second frame component 120 has an open end 127. Accordingly, the second frame component 120 takes the form of a U-shaped frame formed from three edge elements 121-123, each arranged perpendicularly to one another. Recesses 126 are formed at the junction between adjacent edge elements 121-123. Furthermore, brackets 125 are provided between adjacent edge elements 121-123. In addition, brackets 125 are provided at the open end 127 for connection to legs 140.

The kitchen unit 100 comprises two types of legs. Legs 130 are end legs disposable at recesses 116 that form the vertices of the unit 100, such that they form the junction between adjacent edge elements of the frame component 110 or 120. In contrast, legs 140 are intermediate legs, which can be secured to both the frame component 110 and 120, in a recess formed between an edge element 111-114 of the first frame component 110 and an edge element 121-123 of the second frame component 120.

Legs 130, 140 of various lengths may be provided, so as to provide for units 100 of various heights. In one example, the legs 130, 140 are formed from hollow components of similar cross-sectional dimensions as the edge elements 111-114, 121-123.

As shown in FIG. 4, the legs 130, 140 are securable to the frame components 110 by virtue of bolts 150 extending from the frame into the recesses and thereby into the leg 130, 140. Each leg 130, 140 may comprise an array of spaced apart holes (e.g. tapped holes) for receipt of the bolts 150 from several frame components, so as to form layers of the unit 100. The intermediate legs 140 comprise two arrays of spaced apart holes, for respective receipt of bolts 150 from frame components 110 and 120.

As shown in FIG. 5, the leg 130 comprises an adjustable foot portion 131 at one end thereof. The adjustable foot portion 131 assists in levelling the kitchen unit 100. The position of the adjustable foot portion 131 with respect to the leg can be altered, for example by virtue of the adjustable foot portion 131 being threadably connected to the leg. In one example, legs 140 comprise similar adjustable foot portions.

Example dimensions of the components are as follows. In one example, the first frame component 110 is about 600 mm×600 mm. In a further example, the first frame component is 600 mm×300 mm, so as to provide a unit with shallower depth. The second frame component may have similar dimensions. In one example the legs 130,140 are approximately 2.25 m long. The box section of the components may be approximately 50 mm×50 mm.

In use, the kitchen unit 100 is assembled as follows. End legs 130 are secured to the recesses 116 of a first frame component 110*a*, which will form the end vertices of the assembled unit. Intermediate legs 140 are then secured to the remaining recesses 116 of the first frame component 110*a*.

Subsequently, second frame component 120*a* is secured to intermediate legs 140, with the edge elements 121, 123 at the open end of the second frame component 120*a* attaching to the intermediate legs 140. Accordingly, the intermediate legs 140 are positioned in a recess formed between an edge element of the first frame component 110*a* and an edge element of the second frame component 120*a*.

Subsequently, end legs 130 are then secured to the recesses 126 to form the other end vertices of the kitchen unit 100. Accordingly, a first layer of the frame components 110*a*-120*a* is assembled, providing a lowermost layer of the kitchen unit 100.

The process is then repeated for further first frame components 110*b-g* and second frame components 120*b-g*, in successive layers, each layer arranged vertically above a preceding layer to form the remainder of the unit 100. Accordingly, a frame of a kitchen unit 100 is provided.

Subsequently, shelves 160, cabinets 170 and appliances 180 such as ovens, microwaves and dishwashers may be coupled to the frame.

The kitchen unit 100, once assembled, may be freestanding. In other words, the kitchen unit 100 is able to support itself without requiring securement to a wall. It will be appreciated that the kitchen unit 100 may be tethered to a wall for safety reasons, such as to prevent the kitchen unit 100 from being tipped over, whilst still being freestanding by virtue of the fact that the weight of the unit 100 is fully supported by the legs 130, 140, It will be appreciated that some of the first and second frame components 110, 120 may be omitted, so as to provide kitchen units of differing configurations. For example, as shown in FIG. 4, components 110, 120 are omitted in order to provide a sufficient space for receipt of the appliance 180.

In addition, the second frame components 120*a-g* act as extension frames to the first frame components 110*a-g*. It will be appreciated that additional sets of extension frames 120 may be added, so as to provide a larger kitchen unit 100.

In particular, the end legs 130 attached the second frame components 120*a-g* may be replaced with intermediate legs 140, and further second frame components 120 attached thereto. Any number of second frame components and intermediate legs 140 may be connected together in series in this manner, to provide a kitchen unit of arbitrary length.

Figure 6A:
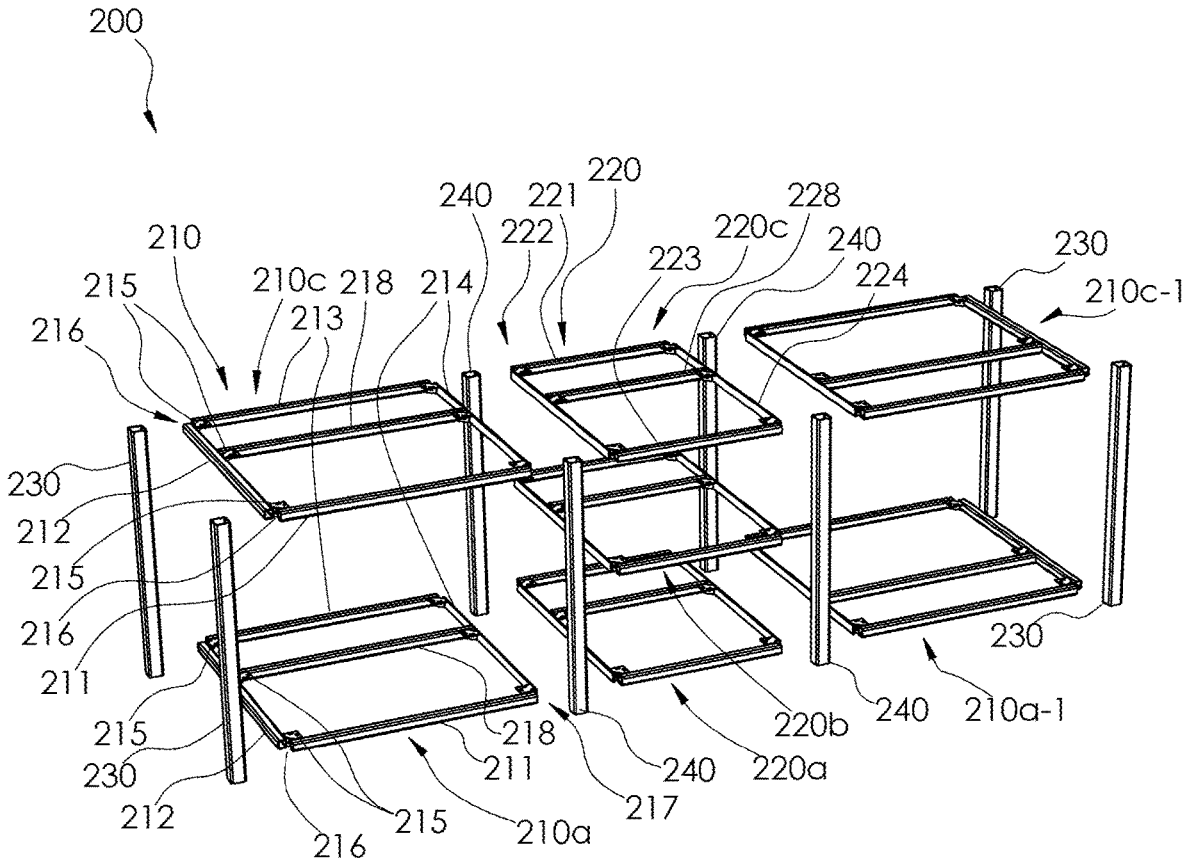
FIGS. 6A and 6B are exploded side and top perspective views of a kitchen unit in accordance with a third example of the disclosure.
Figure 6B:
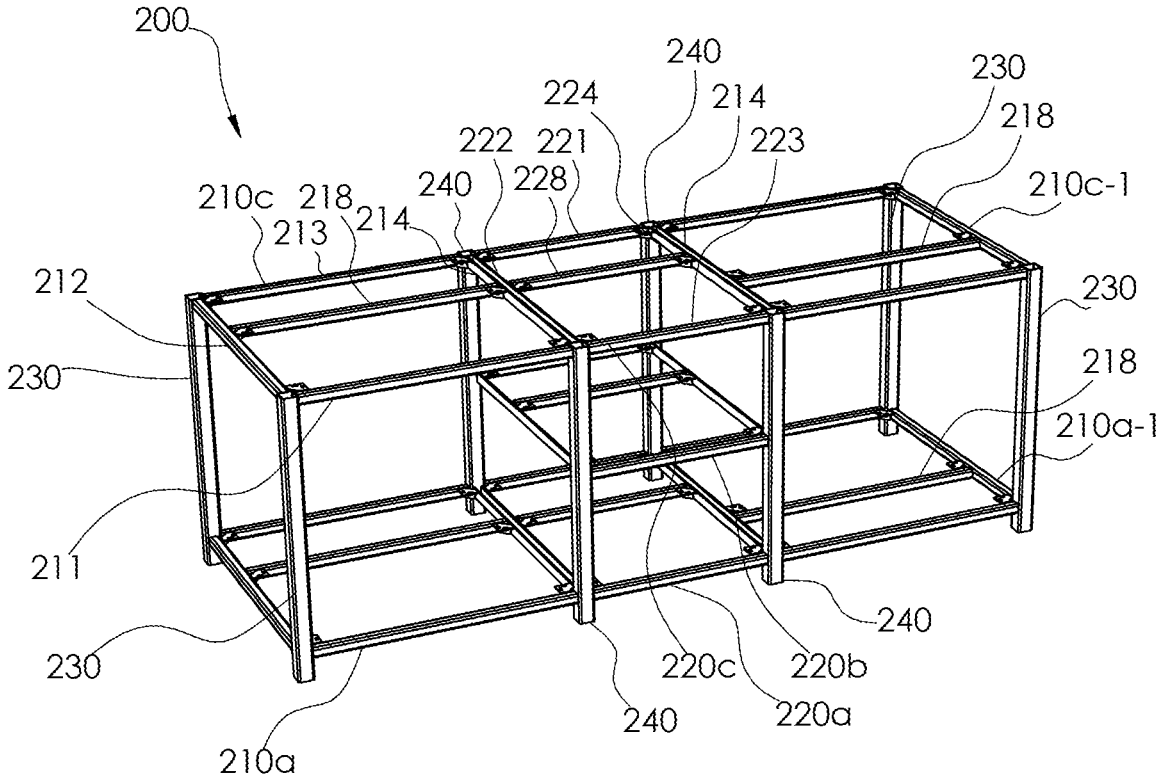
Figure 7:
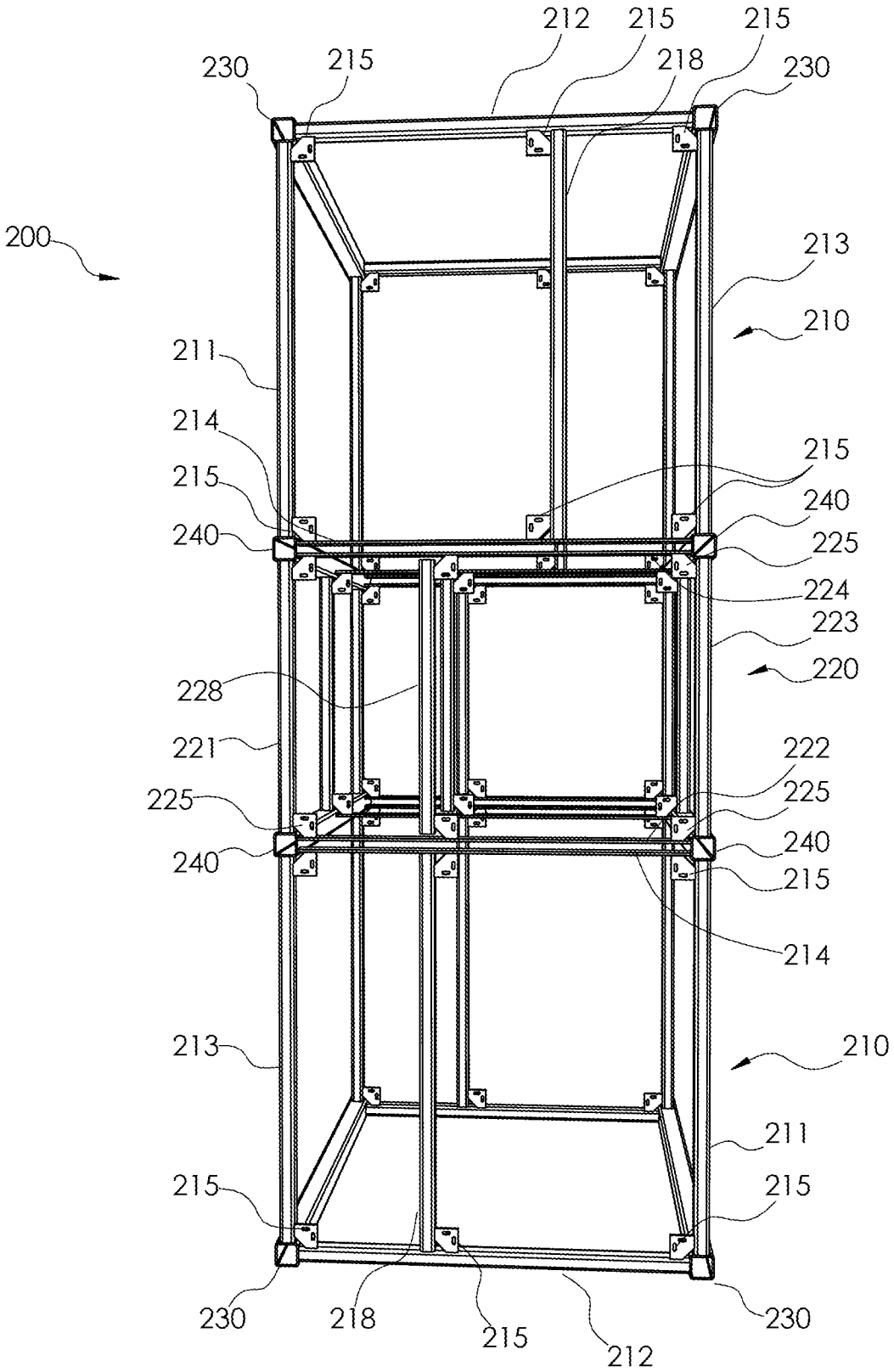
FIG. 7 is a top perspective view of the example kitchen unit of FIG. 6.
Figure 8A:
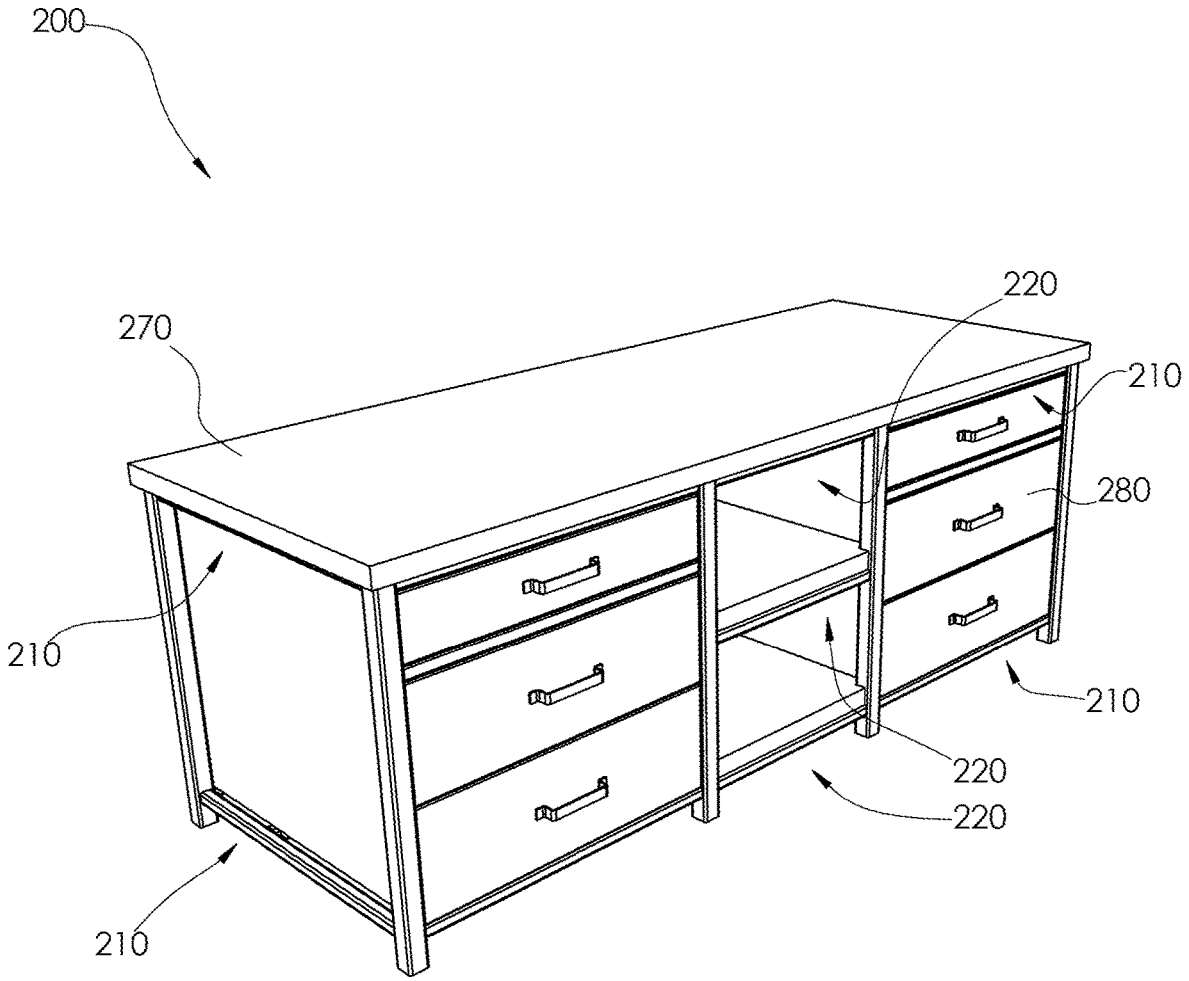
FIGS. 8A and 8B are perspective views of the example kitchen unit of FIGS. 6 and 7 with a worktop, shelves and drawer units attached.
Figure 8B:
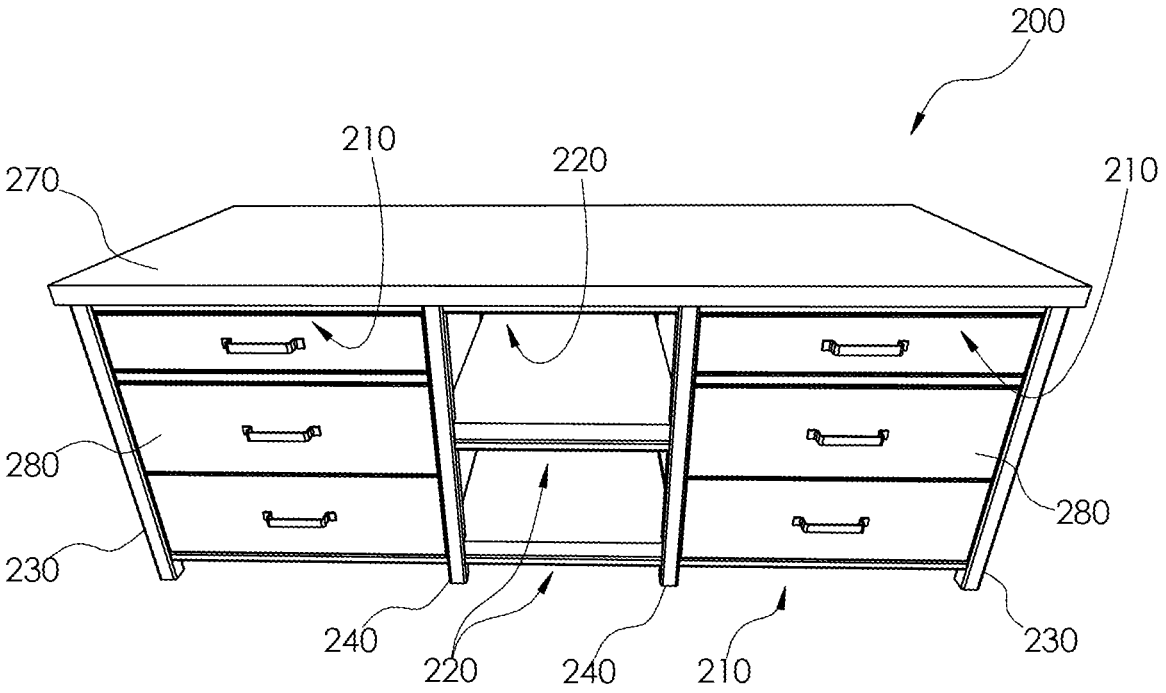

FIG. 6-8 show a further example kitchen unit 200. In this example, the kitchen unit 200 is a kitchen island.

The kitchen unit 200 is formed from a plurality of frame components 210, 220 and a plurality of legs 230, 240. The frame components comprise a plurality of first frame components 210 and a plurality of second frame components 220.

The first frame component 210 is formed from four edge elements 211-214. Similarly to the first frame component 110 described above, each edge element 211-214 is arranged substantially perpendicularly to the neighbouring edge element, so as to form a planar, rectangular frame. In one example, the edge elements are connected by brackets 215 disposed between adjacent edge elements 211-214 within the interior of the frame.

In contrast to the first frame component 110, the first frame component 210 comprises three edge elements 211-213 formed from hollow components having a rectangular (e.g. square) cross-section, and a fourth edge element 214 that is formed from a metal plate.

Recesses 216 are present between adjacent edge elements 211-213. Furthermore, recesses 217 are formed between the edge element 214 and its neighbouring edge elements 211, 213. The recess 217 is sized so as to receive half of the cross-section of the leg 240.

In one example, the first frame component 210 comprises a brace 218, extending across the interior of the component. The brace 218 may prevent deformation of the component and/or provide an extra point of support for shelves attached to the unit 200. In one example, the brace 218 is constructed similarly to edge elements 211-213. In one example, the brace 218 is attached to the frame with brackets 215.

The second frame components 220 are constructed similarly to the first frame components 210, apart from that the hollow edge element opposite the metal plate edge element is replaced with another metal plate edge element. Accordingly, the second frame component comprises edge elements 221, 223 formed from hollow components having a rectangular cross section, and edge elements 222, 224 formed from metal plates. Each of the recesses 227 between adjacent edge elements is sized so as to receive half of the cross-section of the leg 240.

Legs 230 are end legs and legs 240 are intermediate legs, similar to the legs 130,140 discussed above, although sized suitably for a kitchen island rather than a tower unit.

Example dimensions of the components are as follows. In one example, the first frame component 210 is about 600 mm×600 mm, 800 mm×800 mm or 1000 mm×1000 m. In other examples, the frame component 210 may be 600 mm×800 mm, 600×1000 mm, In a further example, the first frame component is 600 mm×300 mm, so as to provide a unit with shallower depth. The second frame component may have similar dimensions. In one example the legs 230,240 are approximately 800 mm to 1000 mm long, for example 870 mm long. The box section of the components may be approximately 50 mm×50 mm or 30 mm×30 mm.

In use, the kitchen unit 200 is assembled as follows. End legs 230 are secured to the recesses 216 of a first frame component 210*a*, which will form the end vertices of the assembled unit. A first pair of intermediate legs 240 is then secured to the remaining recesses 217 of the first frame component 210*a*.

Subsequently, second frame component 220*a* is secured to the first pair of intermediate legs 240. The recesses 217 of the first frame component 210*a* and the recesses 227 of the second frame component 220*a* co-operate to define recesses that fit an intermediate leg 140.

Subsequently, a second pair of intermediate legs 240 are secured to the remaining two recesses 227 of the first frame component 210*a*. A further first frame component 210*a*-1, which is rotated 180 degrees with respect to the first frame component 210*a*, is then secured to the second pair of intermediate legs 240. Finally, a second pair of end legs 230 are secured to the recesses 216 of frame component 210*a*-1, to form the other end vertices of the kitchen unit 200. Accordingly, a first layer of the frame components 210*a*/220*a*/210*a*-1 is assembled, providing a lowermost layer of the kitchen unit 200.

The process is then repeated, in successive layers, each layer arranged vertically above a preceding layer to form the remainder of the unit 200. Accordingly, a frame of a kitchen unit 200 is provided. Again, it will be appreciated that some of the first and second frame components 210, 220 may be omitted, so as to provide kitchen units of differing configurations. For example, as shown in FIG. 6-8, a middle layer of the unit comprises only a second frame component 220, so that drawer units 280 can be fitted to the unit 200 as shown in FIG. 8. A worktop 270 may be secured to a top of the unit 200.

Various modifications and alterations may be made to the above examples within the scope of the invention. A kit may be provided comprising first and second frame components of different dimensions. Particularly, a kit may be provided with a first frame component that is a given size, and a first frame component that is half the size (e.g. half as wide or half as deep), and/or a second frame component that is a given size, and a second frame component that is half the size (e.g. half as wide or half as deep). Accordingly, the components can be selectively used to provide a variety of configurations.

Whilst the examples above involve tubes with rectangular cross-sections, it will be appreciated that circular cross sections may be employed. Furthermore, the order of the steps of assembling the kitchen units 100, 200 described above may be altered.

Advantageously, the above-described kit of parts permits a wide range of kitchen units, such as free-standing towers and islands, to be assembled from a relatively small set of basic components. Accordingly, units formed from tubular steel need not be specially constructed and welded, but instead can be readily assembled from prefabricated modular elements. In addition, the provision of parts of a small number of differing sizes enables a highly flexible system, maximising the range of configurations possible.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A kit of parts for forming a kitchen unit, the kit comprising:

a first frame component comprising a plurality of tubular edge elements;

a second frame component comprising a plurality of tubular edge elements; and a plurality of tubular legs, wherein the plurality of tubular legs comprises:

a plurality of end legs, each configured to be secured to the first frame component in a recess defined by adjacent edge elements of the first frame component such that each of the plurality of end legs abuts ends of adjacent edge elements of the first frame component; and a plurality of intermediate legs configured to be secured to the first frame component and the second frame component in a recess defined by an edge element of the first frame component and an edge element of the second frame component, wherein each of the plurality of intermediate legs abuts the first frame component and abuts the second frame component in a recess defined by an end of a tubular edge element of the first frame component and an end of a tubular edge element of the second tubular frame component.

2. The kit of claim 1, wherein each edge element is connected to a neighbouring edge element by a bracket.

3. The kit of claim 1, wherein each edge element has a rectangular cross-section.

4. The kit of claim 1, wherein each edge element comprises metal.

5. The kit of claim 4, wherein the metal is steel.

6. The kit of claim 1, wherein at least one of the end legs is securable to its respective first frame component by a bolt extending from its respective first frame component into a respective recess and into the end leg.

7. The kit of claim 1, wherein at least one of the intermediate legs is:

securable to its respective first frame component by a first bolt extending from its respective first frame component into a respective recess and into the intermediate leg, and securable to its respective second frame component by a second bolt extending from its respective second frame component into a respective recess and into the intermediate leg.

8. The kit of claim 1, wherein at least one of the end leg and the intermediate leg comprises an adjustable foot portion at one end thereof.

9. The kit of claim 1, wherein the kitchen unit is a tower unit.

10. The kit of claim 1, wherein the kitchen unit is a kitchen island.

11. The kit of claim 1, wherein the kitchen unit is freestanding.

12. The kit of claim 1, wherein at least one of the first frame component and the second frame component comprises a brace.

13. The kit of claim 1, wherein the first frame component comprises four tubular edge elements, each tubular edge element being arranged substantially perpendicularly to a neighbouring edge element.

14. The kit of claim 13, wherein the second frame component comprises:

three tubular edge elements, each tubular edge element being arranged substantially perpendicularly to a neighbouring edge element, and an open end formed between two opposing tubular edge elements by the omission of a fourth tubular edge element, such that the second frame component takes a U-shaped form.

15. The kit of claim 1, wherein the first frame component comprises three tubular edge elements, each edge element being arranged substantially perpendicularly to a neighbouring edge element, and a non-tubular edge element connecting two of the tubular edge elements.

16. The kit of claim 15, wherein the second frame component comprises a pair of tubular edge elements, and a pair of non-tubular edge elements, wherein a first tubular edge element is disposed opposite a second tubular edge element, and a first non-tubular edge element is disposed opposite a second non-tubular edge element.

17. A kitchen unit assembled from the kit of parts of claim 1.

18. A method of manufacturing a kitchen unit, the method comprising assembling the kit of parts of claim 1.

19. A kit of parts for forming a kitchen unit, the kit comprising:

a first frame component comprising a plurality of tubular edge elements;

a second frame component comprising a plurality of tubular edge elements; and a plurality of tubular legs, wherein the plurality of tubular legs comprises:

a plurality of end legs, each configured to be secured to the first frame component in a recess defined by adjacent edge elements of the first frame component such that each of the plurality of end legs abuts ends of adjacent edge elements of the first frame component; and a plurality of intermediate legs configured to be secured to the first frame component and the second frame component in a recess defined by an edge element of the first frame component and an edge element of the second frame component, wherein the first frame component comprises four tubular edge elements, each tubular edge element being arranged substantially perpendicularly to a neighbouring edge element, and wherein the second frame component comprises:

three tubular edge elements, each tubular edge element being arranged substantially perpendicularly to a neighbouring edge element, and an open end formed between two opposing tubular edge elements by the omission of a fourth tubular edge element, such that the second frame component takes a U-shaped form.

* * * * *